US010093514B2

(12) United States Patent
Brunschwiler

(10) Patent No.: US 10,093,514 B2
(45) Date of Patent: Oct. 9, 2018

(54) COLLATING APPARATUS AND A METHOD FOR OPERATING SUCH A COLLATING APPARATUS

(71) Applicant: Othmar Brunschwiler, Bettwiesen (CH)

(72) Inventor: Othmar Brunschwiler, Bettwiesen (CH)

(73) Assignee: FERAG AG, Hinwil (CH)

( * ) Notice: Subject to any disclaimer, the term of this patent is extended or adjusted under 35 U.S.C. 154(b) by 139 days.

(21) Appl. No.: 15/017,334

(22) Filed: Feb. 5, 2016

(65) Prior Publication Data

US 2016/0229656 A1 Aug. 11, 2016

(30) Foreign Application Priority Data

Feb. 6, 2015 (CH) ..... 158/15

(51) Int. Cl.

| | |
|---|---|
| ***B65H 39/02*** | (2006.01) |
| ***B65H 39/04*** | (2006.01) |
| ***B65H 39/043*** | (2006.01) |
| ***B65H 39/06*** | (2006.01) |

(Continued)

(52) U.S. Cl.

CPC ..... *B65H 39/02* (2013.01); *B65H 37/02* (2013.01); *B65H 39/04* (2013.01); *B65H 39/043* (2013.01); *B65H 39/06* (2013.01); *B65H 39/115* (2013.01); *B65H 2301/444* (2013.01); *B65H 2301/4454* (2013.01); *B65H 2301/4455* (2013.01); *B65H 2301/44514* (2013.01)

(58) Field of Classification Search

CPC ..... B65H 39/02; B65H 39/04; B65H 39/06; B65H 39/043; B65H 39/115; B65H 2301/444; B65H 2301/4455; B65H 2301/44514; B65H 2301/4454

USPC ..... 270/52.14, 52.16, 58.18

See application file for complete search history.

(56) References Cited

U.S. PATENT DOCUMENTS 4,639,873 A 1/1987 Baggarly et al.
5,678,813 A * 10/1997 Osako ..... B42B 4/00 270/52.16

(Continued)

FOREIGN PATENT DOCUMENTS

EP 0 680 916 A1 11/1995
EP 2 107 023 A1 10/2009

(Continued)

*Primary Examiner* — Leslie A Nicholson, III

(74) *Attorney, Agent, or Firm* — Pauley Erickson & Kottis

(57) ABSTRACT

A collating apparatus (10), in particular for printed products such as brochures, flyers or the like, comprising a collecting section (11) having at least two collecting zones (11*a,b*) arranged in parallel and working independently of each other, onto which respectively a plurality of products are fed successively and are united lying one on top of the other into a collected product, and at least one further processing section (13, 15) positioned behind the collecting section (11) having at least one further processing apparatus (13*a,b;* 15*a,b*). High flexibility during operation is achieved by the arrangement between the collecting section (11) and the at least one further processing section (13, 15) of a distribution apparatus (12), which feeds the collected products arriving from the collecting zones (11*a,b*) selectively to the at least one further processing apparatus (13*a,b,* 15*a,b*).

20 Claims, 4 Drawing Sheets

(51) Int. Cl.
*B65H 37/02* (2006.01)
*B65H 39/115* (2006.01)

(56) References Cited

U.S. PATENT DOCUMENTS 6,659,445 B2 * 12/2003 Boss ..... B65H 29/6609 271/184
7,073,785 B2 * 7/2006 Leu ..... B65H 5/301 270/52.14
7,677,543 B2 * 3/2010 Gulbrandsen ..... B65H 5/26 198/418.1
8,443,963 B2 * 5/2013 Cooper ..... B65H 29/60 198/571
8,596,632 B2 * 12/2013 Silberbauer ..... B42C 1/10 270/52.14
8,661,975 B2 * 3/2014 Feyerabend ..... B65H 29/58 101/232
8,733,752 B2 * 5/2014 Heiniger ..... B65H 39/02 270/52.14

FOREIGN PATENT DOCUMENTS

WO WO 2004/013026 A1 2/2004
WO WO 2011/144451 A1 11/2011
WO WO 2012/084464 A2 6/2012
WO WO 2012/084494 A2 6/2012

* cited by examiner

COLLATING APPARATUS AND A METHOD FOR OPERATING SUCH A COLLATING APPARATUS

CROSS-REFERENCE TO RELATED APPLICATION

Swiss Patent Application 00158/15, filed 6 Feb. 2015, the priority document corresponding to this invention, to which a foreign priority benefit is claimed under Title 35, United States Code, Section 119, and its entire teachings are incorporated, by reference, into this specification.

BACKGROUND OF THE INVENTION

Field of the Invention

The present invention relates to the field of post press processing. It concerns a collating apparatus according to the preamble to Claim 1. It further concerns a method for operating such a collating apparatus.

Discussion of Related Art

Already familiar for some time under the heading "Direct Mailing" are activities in which advertising leaflets, brochures, flyers, printed sheets and the like, which are usually frequently included (inserted) for advertising purposes as enclosures in a newspaper, are collected from a number of originators, in order to produce a plurality of compilations therefrom, which respectively contain a printed product from each originator and are delivered or distributed in the form of a small stack to the recipients, e.g. households.

In order to be able to handle the individual stack-like compilations of the printed products more effectively during transport and distribution, it is advantageous to take measures to keep the individual stacks together.

It is familiar from the prior art, in the event that one of the printed products is folded, to open this printed product and to insert the other printed products into the opened printed product.

This is performed in practice by hand by those persons who distribute the compilations in the areas allocated to them. For this purpose, the individual printed products are delivered to particular locations in the form of packed stacks. The stacks must then be unpacked by hand, and the printed products must be removed individually from the various stacks and united to produce the desired compilation.

It is self-evident that, although forming of the compilations by hand by the persons involved in their distribution does not involve any equipment costs, it is nevertheless extraordinarily time-consuming, particularly when large quantities are to be distributed, and it greatly delays the distribution process and gives rise to additional personnel costs.

It may accordingly be financially more advantageous under certain circumstances to execute the forming and provision of the compilations centrally and by machine, and to provide the persons responsible for their distribution with the finished compilations.

The above-mentioned insertion process, in which a folded printed product is opened and the other printed products are inserted into the opened printed product, nevertheless calls for considerable investment in machinery.

It is conceivable, on the other hand, to hold the compilation of printed products together by placing an adhesive or non-adhesive strip laterally around one edge of the compilation. Such a technology is familiar to the applicant, e.g. from WO 2012/084464 A2 or from WO 2012/084494 A2.

Familiar from EP 2 107 023 A1, furthermore, is a method for generating a stream of flat products, in particular printed products, in a predetermined sequence, the products arriving from a number of feed flows being dispensed in a controlled manner in a plurality of delivery positions lying one after the other along at least one grouping section on at least one conveyor moving continuously along a closed circulation path and being moved to a further processing station. Only those products whose sequence corresponds to the predetermined sequence are transferred to the further processing station, the dispensing of new products from the feed flows to the conveyor being interrupted following detection of a fault, without interrupting the movement of the conveyor, the partial stream present on the conveyor being fed back to the grouping section at least from a fault location corresponding to the fault, and the fault being corrected by the delivery of the corresponding product or the corresponding products.

Familiar from WO 2011/144451 A1 is a post press processing installation for combining and further processing of flat precursors, which comprises a combining apparatus having a conveyor track, on which a plurality of receiving units arranged one after the other in the revolving direction in order to receive precursors to be combined circulates in a closed system, and on which a number of feed devices are arranged one after the other in the revolving direction in at least one combining zone, from which precursors are dispensed into the receiving units as they move past on the conveyor track. A transfer device is arranged along at least one point on the conveyor track, which transfers combined first partial collections from the receiving units for further processing. A collator is arranged at least at one further point on the conveyor track or at a distance therefrom, which collates combined further partial collections from the receiving units with the first partial collections, or combines the first partial collection comprising printed products into collections.

There is a desire, on the other hand, to create an apparatus with which individual printed products can be collated, in a predetermined and at all times variable manner, into compilations and can be made ready for distribution rapidly, flexibly and with reduced equipment costs.

SUMMARY OF THE INVENTION

An object of the invention is thus to make available such an apparatus and to propose a method for its operation.

These and other objects are accomplished by the features of Claims 1, 12 and 13. Embodiments of the invention can be appreciated from the dependent Claims.

The collating apparatus according to the invention, which is suitable in particular for printed products such as brochures, flyers or the like, comprises a collecting section having at least two collecting zones arranged in parallel and working independently of each other, onto which a plurality of products are fed successively and are united lying one on top of the other into a collected product, and at least one further processing section having at least one further processing apparatus positioned behind the collecting section.

It is characterized in that arranged between the collecting section and the at least one further processing section is a distribution apparatus, which feeds the collected products arriving from the collecting zones selectively to one of the at least one further processing apparatus.

One embodiment of the collating apparatus according to the invention is characterized in that the at least one further processing section comprises two further processing apparatuses arranged in parallel and working independently of each other, and in that the distribution apparatus feeds the collected products arriving from the collecting zones selectively to one or both further processing apparatuses.

Another embodiment of the collating apparatus according to the invention is characterized in that the collecting zones are designed for synchronous operation.

A further embodiment of the collating apparatus according to the invention is characterized in that the distribution apparatus is configured as a diverter module, which transfers the collected products arriving from the collecting zones as product streams selectively into the at least one further processing section.

In particular in the case of the two further processing apparatuses, the distribution apparatus can be configured as a diverter module, which feeds the collected products arriving from the collecting zones as product streams selectively to one or both further processing apparatuses.

In particular, the diverter module can be designed as a double switch, which is able to divide the product streams into partial streams after having been collated.

Provided that the diverter module in this case comprises two partial modules connected one after the other, a fixing device can be arranged between the partial modules.

Another embodiment of the collating apparatus according to the invention is characterized in that the collecting zones respectively comprise a revolving conveyor belt, on which a plurality of delivery stations for feeding the individual products is arranged one after the other in the direction of feed.

A further embodiment of the collating apparatus according to the invention is characterized in that the at least one further processing section comprises, as further processing apparatuses, two fixing devices for fixing the collected products arriving from the collecting zones.

In particular, the fixing devices provide the individual collected products with at least one fixing element, in particular with a wrapper or adhesive tape.

In particular arranged behind the at least one further processing section is a further processing section, which comprises, as further processing apparatuses, two stacking devices allocated to the fixing devices.

The at least two collecting zones can be configured identically and can have the same number of feeding stations. The collecting zones can also vary in length, however, and can be provided with a different number of feeding stations.

A method according to the invention for the operation of a collating apparatus according to the invention is characterized in that first and second collected products are assembled on the at least two collecting zones, and in that the first and second collected products are processed further separately in the following at least one further processing section.

Another method for the operation of a collating apparatus according to the invention is characterized in that first and second collected products are assembled in the at least two collecting zones, in that the first and second collected products are collated respectively by means of the distribution apparatus into third collected products, and in that the third collected products are processed further in the following at least one further processing section.

In particular the third collected products can be divided up into partial streams in the distribution apparatus for further processing.

BRIEF DESCRIPTION OF THE DRAWINGS

The invention is now explained below in more detail in connection with the drawing on the basis of illustrative embodiments. In the drawing.

DESCRIPTION OF PREFERRED EMBODIMENTS

Figure 1:
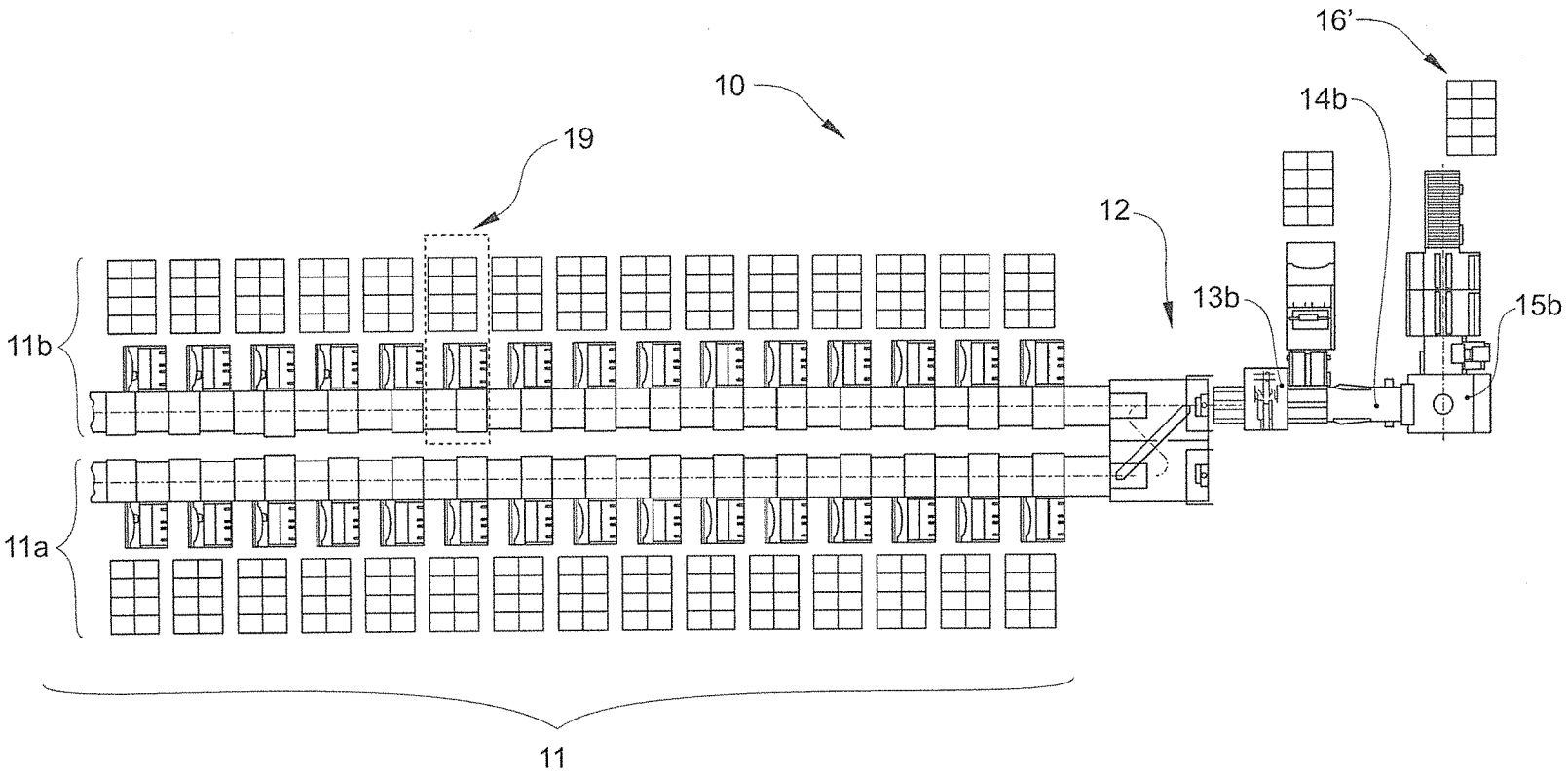
FIG. 1 depicts, in the top view from above, a first illustrative embodiment of a collating apparatus according to the invention having two identical collecting zones in a parallel arrangement, a simple diverter module, a fixing device and a stacking device.

A first illustrative embodiment of a collating apparatus according to the invention is depicted in the top view from above in FIG. 1. The collating apparatus 10 in FIG. 1 comprises a collecting section 11 having two collecting zones 11*a*, 11*b* of identical construction configured as a mirror image to one another. The collecting zones 11*a* and 11*b*, which in FIG. 1 have a direction of feed from left to right, are capable of connection selectively via a diverter module 12 to a further processing section, which in the example has a first further processing apparatus 13*b* and downstream thereof a second further processing apparatus 15*b*, which are connected to each other by a conveyor 14*b*.

Arranged one after the other on the collecting zones 11*a,b* in the direction of feed are a number (in the illustrated example fifteen) of delivery stations 19 (FIG. 4), which deposit individual printed products flat on the collecting zone, which printed products are then collated into a collected product.

In the example in FIG. 1, the first further processing apparatus 13*b* is a fixing device, which fixes collected products fed from the collecting zones 11*a,b* for further handling by wrapping with at least one tape or at least one further printed product. The second further processing apparatus 15*b* in this case is a stacking device, which gathers the fed collected products into stacks and makes them ready for despatch in the form of a package pallet 16'.

The diverter module 12 arranged between the collecting zones 11*a,b* and the further processing apparatuses can assume and perform various functions. On the one hand, it can unite the collected products from both collecting zones into a third collected product. This can continue to take place for all collected products. It is also conceivable, however, to unite only selected collected products from the one collecting zone with selected collected products from the second collecting zone. However, it is also able to convey selectively the collected products from only one collecting zone for further processing, if the other collecting zone is not in operation or has been paused.

Flexible operation of the apparatus 10 is already possible in this way.

Figure 2:
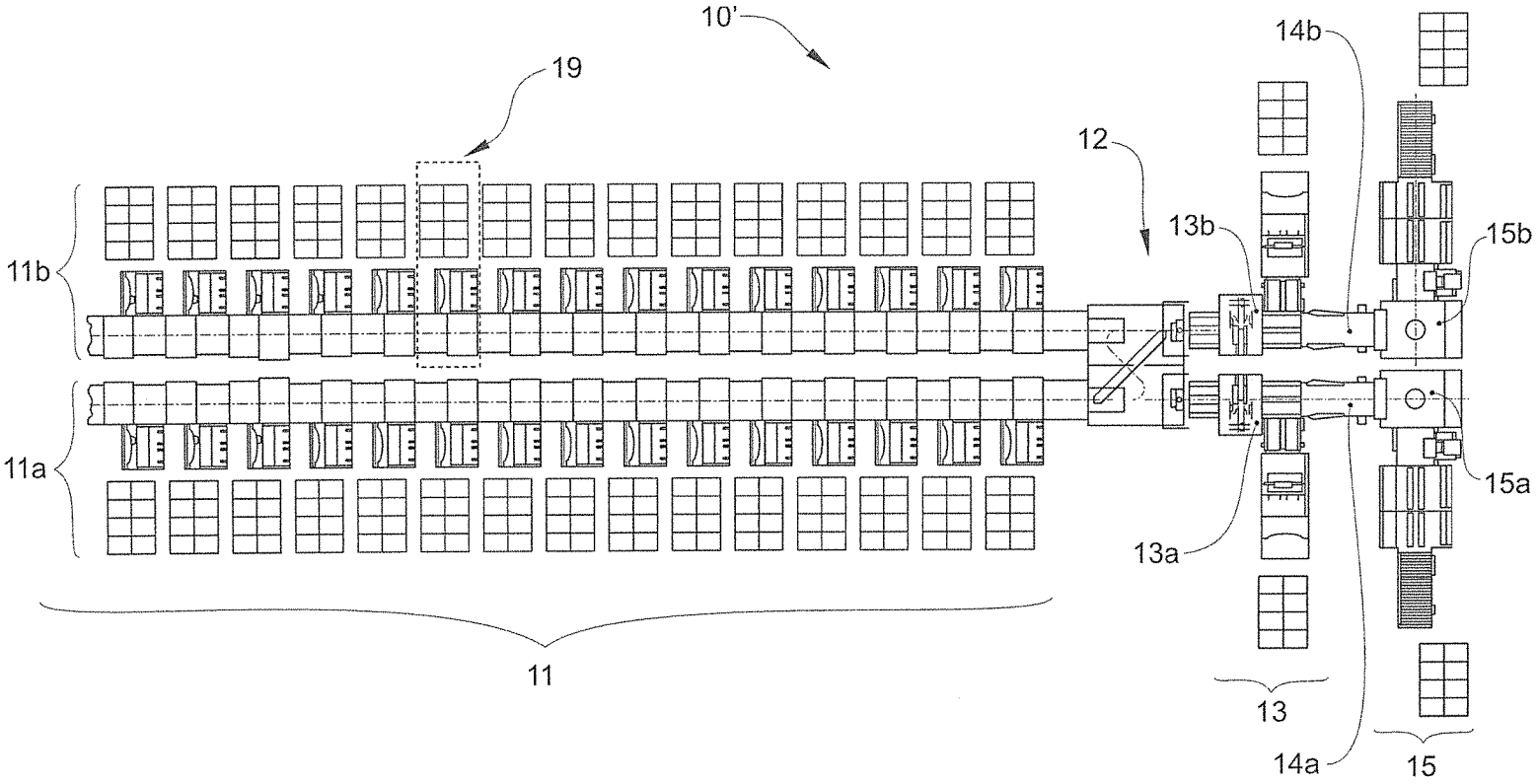
FIG. 2 depicts, in the top view from above, a second illustrative embodiment of a collating apparatus according to the invention having two identical collecting zones, fixing devices and stacking devices in a parallel arrangement, as well as a simple diverter module.

A second illustrative embodiment of a collating apparatus according to the invention is depicted in FIG. 2 in the top view from above, which permits even more operating modes. The collating apparatus 10' in FIG. 2 comprises two production lines 11*a*, 13*a*, 14*a* and 15*a* and 11*b*, 13*b*, 14*b* and 15*b* of identical construction configured as a mirror image to one another, which are in mutual contact with one another at a single point via a diverter module 12.

Both production lines are subdivided respectively into a collecting section 11, a first further processing section 13 and a second further processing section 15. The two further processing sections 13 and 15 of the two production lines 11*a*, 13*a*, 14*a* and 15*a* or 11*b*, 13*b*, 14*b* and 15*b* are connected respectively by a conveyor 14*a* or 14*b*.

Figure 4:
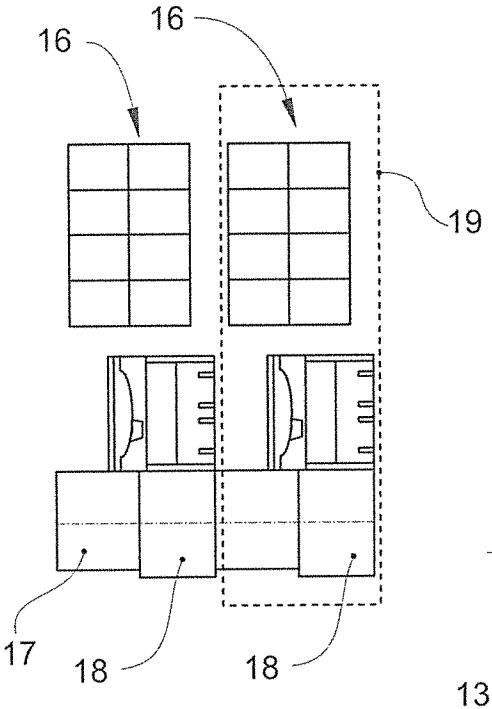
FIG. 4 depicts, in an enlarged view, a section through a collecting zone in FIGS. 1-3 having two feeding stations.

Arranged in turn parallel to one another in the collecting section 11 and capable of operation independently of one another are two collecting zones 11*a* and 11*b*, which comprise two revolving conveyor belts 17 or comparable conveyor devices positioned close to one another (FIG. 2), for example cam chains, on which compartments or depositing positions, for example, are defined at regular intervals, in which the individual printed products can be deposited for collection. The conveyor belts 17 guide the compartments or depositing positions past the delivery stations 19 arranged one after the other in the direction of feed, where a predetermined printed product is fed to them respectively by a feed device 18 (FIG. 4). Once a single compartment has been moved past all the (active) delivery stations 19, the printed products fed to the delivery stations 19, as already described above, will have been gathered together therein as a collected product, which can then be fed for subsequent further processing.

The feed devices 18 may be comparatively simple separators, for example, to which the respective printed product is fed from the outside by an operative in the form of stacks from a package pallet 16 (FIG. 4), and which then separate the printed products by withdrawing them from the stack and deposit them flat on the conveyor belt of the associated collecting zone 11*a,b*.

Both collecting zones 11*a* and 11*b*, acting independently of one another, although coordinated with one another, dispense at their ends (on the right in FIG. 1) collected products, the further processing of which is then determined by the selectable operating position of the following diverter module 12. The diverter module 12 links the outlets from the two collecting zones 11*a* and 11*b* in the manner of a track switch. Fundamentally three different diverter positions are possible in this case. In the first diverter position, the collected products from the lower collecting zone 11*a* are added upwards to the collected products of the upper collecting zone 11*b*, so that a third collected product is created from both of these collected products, which is further processed as a collected product.

In the second diverter position, the collected products from the lower collecting zone 11*a* and from the upper collecting zone 11*b* are fed separately for further processing and are further processed separately there.

In the third diverter position, the collected products from the upper collecting zone 11*b* are added downwards to the collected products from the lower collecting zone 11*a*, so that a fourth collected product is created from both of these collected products, which is further processed as a collected product.

The diverter position in this case can remain constant for a succession of collected products, although it can also be modified or switched selectively during continuing operation, in order to produce different collected products alternately.

This results in an exceptionally flexible and versatile collating system, which operates in parallel in the case of small collected products and can provide high throughputs or complex, large and differing collected products, in return for a comparatively low equipment-related space requirement, by collating two collecting zones disposed adjacent to one another.

Figure 5:
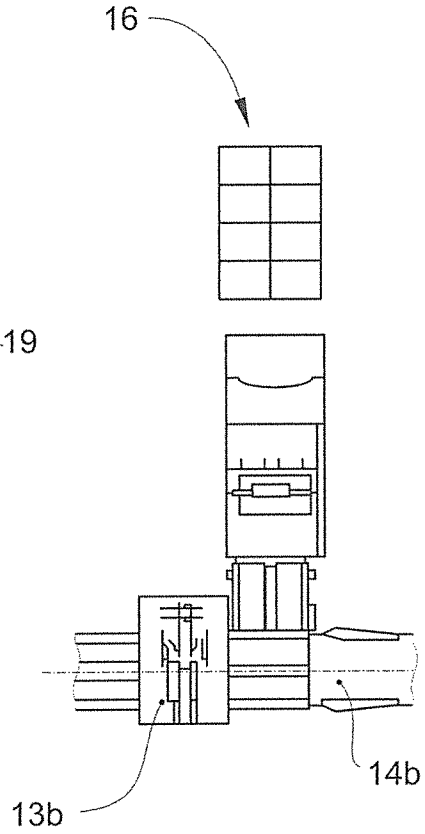
FIG. 5 depicts, in an enlarged view, a fixing device from the collating apparatus according to FIGS. 1-3.

In the illustrative embodiment in FIG. 2, the further processing of the collected products in the further processing section 13 in separate further processing apparatuses 13*a* and 13*b* again comprises the fixing of the formed collected products with a wrapper, in particular in the form of a wrapped further printed product, or an adhesive tape (Tapefix) fixing element, the fixing elements being fed to the apparatus from the outside in the form of stacks or being drawn from a roll (FIG. 5).

For subsequent further processing in the further processing section 15, the fixed collected products are conveyed onwards via two separate conveyors 14*a* and 14*b* to stacking devices 15*a* and 15*b*, where the final packing (binding, film wrapping, paletization, etc.) is carried out. The end result is package pallets 16', which can be transported to the distributors.

Figure 3:
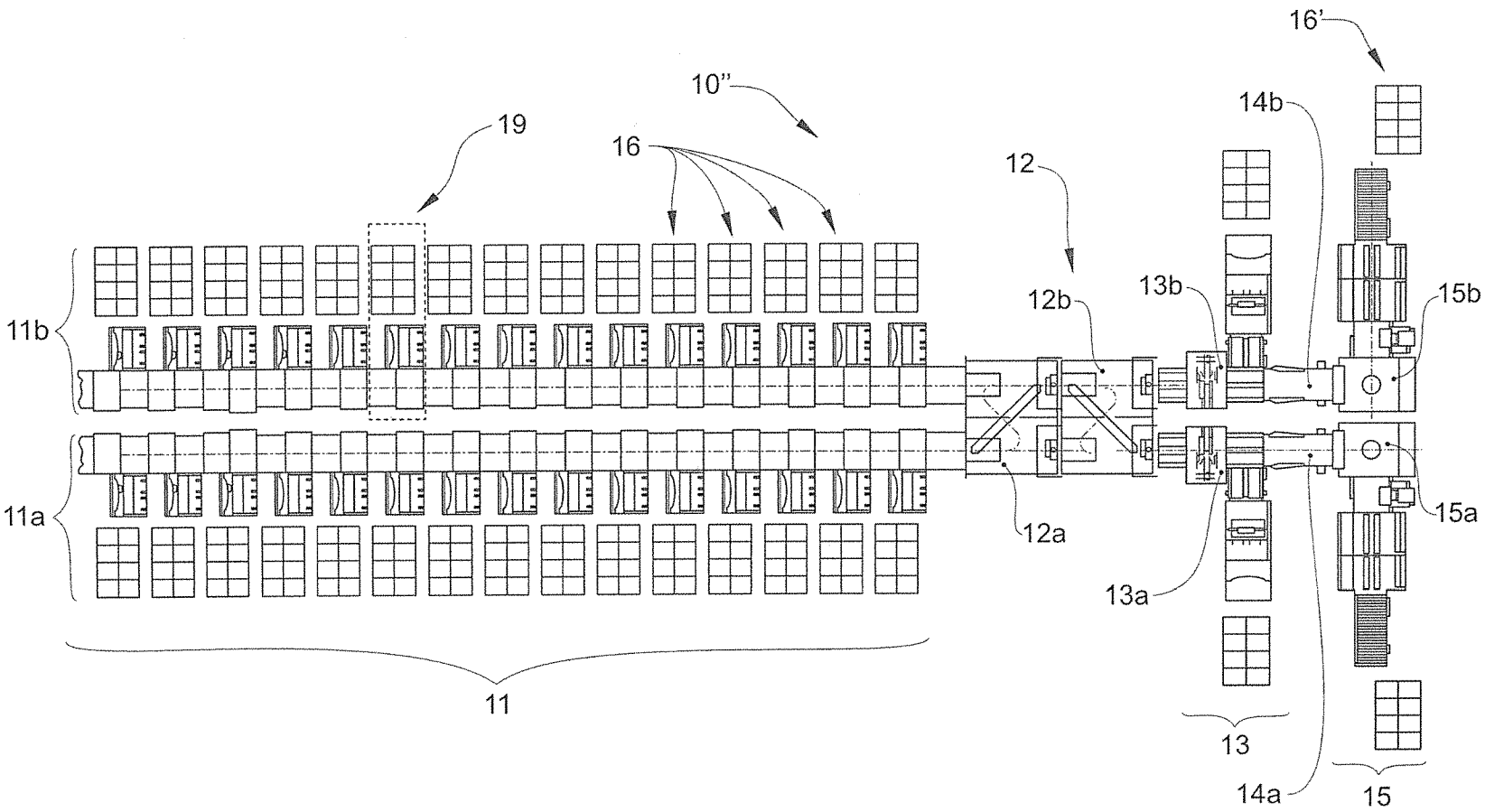
FIG. 3 depicts, in the top view from above, a third illustrative embodiment of a collating apparatus according to the invention having two identical collecting zones, fixing devices and stacking devices in a parallel arrangement, as well as a diverter module configured as a double switch.
Figure 6:
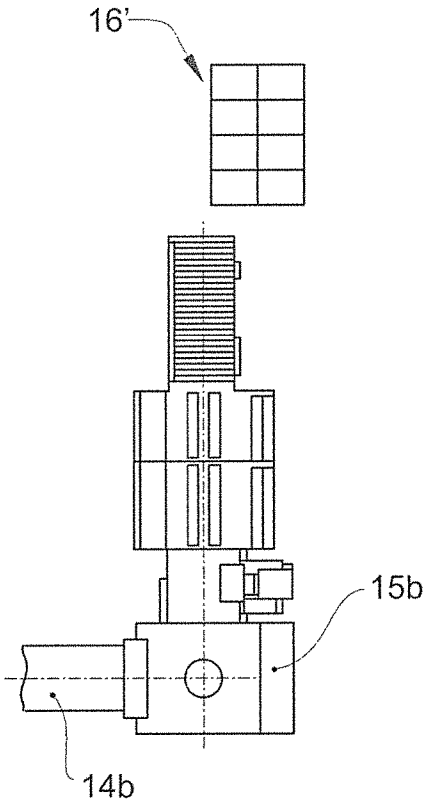
FIG. 6 depicts, in an enlarged view, a stacking device from the collating apparatus according to FIGS. 1-3.

An even greater degree of flexibility is achieved if, according to the illustrative embodiment depicted in FIG. 3, the collating apparatus 10" comprises a diverter module 12, which is configured as a double switch having two partial modules 12*a* and 12*b* arranged one after the other.

Whereas the other parts of the collating apparatus 10" are identical in respect of the arrangement and function of the collating apparatus 10' in FIG. 2, an operating mode can be realized with the help of the partial modules 12*a* and 12*b* of the diverter module, in which the collected products from the two collecting zones 11*a* and 11*b* are collated by the first partial module 12*a* in the diverter module 12 into a third collected product, and the product stream from the third collected products is then divided immediately afterwards in the following partial module 12*b* into two partial streams, which are then processed further separately in the further processing sections 13*a*, 14*a*, 15*a* or 13*b*, 14*b*, 15*b*.

Such an operating mode makes sense, for example, if the stacking devices 15*a* and 15*b* only permit limited stack heights. As a result of the division into partial streams, both stacking devices 15*a* and 15*b* can then be uniformly loaded without being restricted by the height of the stack.

It is also conceivable in this connection to utilize a fixing device between the two partial modules 12*a* and 12*b*, which already undertakes the above-mentioned fixing to the collected products before the division into partial streams.

I claim:

1. A collating apparatus (10, 10', 10") for printed products such as brochures, flyers or the like, comprising:

a collecting section (11) having at least two collecting zones arranged in parallel and working independently of each other (11*a,b*), onto which respectively a plurality of products are fed successively and are united lying one on top of the other into a collected product;

at least one further processing section (13, 15) positioned behind the collecting section (11) having at least one further processing apparatus (13*a,b*; 15*a,b*); and a distribution apparatus (12) arranged between the collecting section (11) and the at least one further processing section (13, 15), the distribution apparatus feeding the collected products arriving from the collecting zones (11*a,b*) selectively to the at least one further processing apparatus (13*a,b*; 15*a,b*), wherein the distribution apparatus comprises a diverter module (12) that links collected product outlets of each of the collecting zones (11*a,b*) and selectively transfers product streams arriving from the collecting zones (11*a,b*) into the at least one further processing section (13, 15), wherein the diverter module (12) moves between more than one selectable operating position between the at least two collecting zones.

2. The collating apparatus according to claim 1, wherein the at least one further processing section (13, 15) comprises two further processing apparatuses (13*a,b*; 15*a,b*) arranged in parallel and working independently of each other, and in that the distribution apparatus (12) feeds the collected products arriving from the collecting zones (11*a,b*) selectively to one or both further processing apparatuses (13*a,b*; 15*a,b*).

3. The collating apparatus according to claim 2, wherein the diverter module (12) feeds the collected products arriving from the collecting zones (11*a,b*) as product streams selectively into one or both of the further processing apparatuses (13*a,b*; 15*a,b*).

4. The collating apparatus according to claim 3, wherein the diverter module (12) comprises a double switch (12*a*, 12*b*), which is able to divide the product streams into partial streams after having been collated.

5. The collating apparatus according to claim 4, wherein the diverter module (12) comprises two partial modules (12*a*, 12*b*) connected one after the other, and in that a fixing device is arranged between the partial modules (12*a*, 12*b*).

6. The collating apparatus according to claim 2, wherein the at least one further processing section (13) comprises, as further processing apparatuses, two fixing devices (13*a,b*) for fixing the collected products arriving from the collecting zones (11*a,b*).

7. The collating apparatus according to claim 6, wherein the fixing devices (13*a,b*) provide the individual collected products with at least one fixing element.

8. The collating apparatus according to claim 6, wherein arranged behind the at least one further processing section (13) is a further processing section (15), which comprises, as further processing apparatuses, two stacking devices (15*a,b*) allocated to the fixing devices (13*a,b*).

9. The collating apparatus according to claim 1, wherein the collecting zones (11*a,b*) respectively comprise a revolving conveyor belt (17), on which a plurality of delivery stations (19) for feeding the individual products is arranged one after the other in the direction of feed.

10. A method for the operation of a collating apparatus according to claim 1, the method comprising assembling first and second collected products in the at least two collecting zones (11*a,b*), and separately processing the first and second collected products in the following at least one further processing section (13, 15).

11. The method for the operation of a collating apparatus according to claim 10, wherein the first and second collected products are assembled in the at least two collecting zones (11*a,b*), in that the first and second collected products are collated respectively by the distribution apparatus (12) into third collected products, and in that the third collected products are processed further in the following at least one further processing section (13, 15).

12. The method according to claim 11, wherein the third collected products are divided up into partial streams in the distribution apparatus (12) for further processing.

13. The collating apparatus according to claim 1 wherein the diverter module (12) moves between three different diverter positions.

14. The collating apparatus according to claim 1, wherein the diverter module (12) switches an operating position to produce different collected products from the at least two collecting zones.

15. The collating apparatus according to claim 1, wherein the diverter module (12) comprises a first switch module adapted to switch first operating positions to produce different collected products from the at least two collecting zones, and a second switch module adapted to switch second operating positions to selectively transfer the product streams between two further processing apparatuses (13*a,b*; 15*a,b*).

16. The collating apparatus according to claim 15, wherein the first switch module switches positions between the collected product outlets of each of the collecting zones (11*a,b*) to selectively alternate or combine the plurality of products to form two collected products from the collecting section (11).

17. A collating apparatus (10, 10', 10") for printed products such as brochures, flyers or the like, comprising:

a collecting section (11) having at least two collecting zones arranged in parallel and working independently of each other (11*a,b*), onto which respectively a plurality of products are fed successively and are united lying one on top of the other into a collected product;

at least one further processing section (13, 15) positioned behind the collecting section (11) having at least one further processing apparatus (13*a,b*; 15*a,b*); and a distribution apparatus (12) arranged between the collecting section (11) and the at least one further processing section (13, 15), the distribution apparatus feeding the collected products arriving from the collecting zones (11*a,b*) selectively to the at least one further processing apparatus (13*a,b*; 15*a,b*), wherein the distribution apparatus comprises a diverter module (12) that links collected product outlets of each of the collecting zones (11*a,b*) and selectively transfers product streams arriving from the collecting zones (11*a,b*) into the at least one further processing section (13, 15), wherein the diverter module (12) comprises a track switch having more than one operating position, wherein each of the more than one operating position of the diverter module (12) determines a further processing of the collected products.

18. The collating apparatus according to claim 17, wherein the at least one further processing section (13, 15) comprises two further processing apparatuses (13*a,b*; 15*a,b*) arranged in parallel and working independently of each other, and in that the distribution apparatus (12) feeds the collected products arriving from the collecting zones (11*a,b*) selectively to one or both further processing apparatuses (13*a,b*; 15*a,b*).

19. A collating apparatus (10, 10', 10") for printed products such as brochures, flyers or the like, comprising:

a collecting section (11) having at least two collecting zones arranged in parallel and working independently of each other (11*a,b*), onto which respectively a plurality of products are fed successively and are united lying one on top of the other into a collected product;

at least one further processing section (13, 15) positioned behind the collecting section (11) having at least one further processing apparatus (13*a,b*; 15*a,b*); and a distribution apparatus (12) arranged between the collecting section (11) and the at least one further processing section (13, 15), the distribution apparatus feeding the collected products arriving from the collecting zones (11*a,b*) selectively to the at least one further processing apparatus (13*a,b*; 15*a,b*), wherein the distribution apparatus comprises a diverter module (12) that links collected product outlets of each of the collecting zones (11*a,b*) and selectively transfers product streams arriving from the collecting zones (11*a,b*) into the at least one further processing section (13, 15), wherein the diverter module (12) switches an operating position to divide the collected products from the at least two collecting zones into more than one product stream for separate processing.

20. The collating apparatus according to claim 19, wherein the at least one further processing section (13, 15) comprises two further processing apparatuses (13*a,b*; 15*a,b*) arranged in parallel and working independently of each other, and in that the distribution apparatus (12) feeds the collected products arriving from the collecting zones (11*a,b*) selectively to one or both further processing apparatuses (13*a,b*; 15*a,b*).

* * * * *